US008814718B1

(12) United States Patent
Rollinson et al.

(10) Patent No.: US 8,814,718 B1
(45) Date of Patent: Aug. 26, 2014

(54) VARIABLE LENGTH GOLF CLUB SHAFT

(75) Inventors: Augustin W. Rollinson, Carlsbad, CA (US); James A. Nycum, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 186 days.

(21) Appl. No.: 13/544,536

(22) Filed: Jul. 9, 2012

Related U.S. Application Data

(60) Provisional application No. 61/577,366, filed on Dec. 19, 2011.

(51) Int. Cl.
*A63B 53/16* (2006.01)

(52) U.S. Cl.
USPC ..... 473/296; 473/299

(58) Field of Classification Search
CPC .. A63B 49/0288; A63B 53/145; A63B 53/16; A63B 59/044
USPC ..... 473/296, 239, 297–299
See application file for complete search history.

(56) References Cited

U.S. PATENT DOCUMENTS

| | | | | |
|---|---|---|---|---|
| 4,943,059 | A * | 7/1990 | Morell | 473/306 |
| 6,656,057 | B2 * | 12/2003 | Manual et al. | 473/300 |
| 6,935,968 | B1 * | 8/2005 | Thomas | 473/296 |
| 7,621,821 | B2 * | 11/2009 | Tsai et al. | 473/306 |
| 8,348,783 | B2 * | 1/2013 | Soracco et al. | 473/296 |
| 8,454,451 | B2 * | 6/2013 | Evans et al. | 473/296 |
| 8,591,350 | B2 * | 11/2013 | Evans et al. | 473/296 |
| 8,647,462 | B2 * | 2/2014 | Su et al. | 156/245 |
| 2002/0091013 | A1 * | 7/2002 | Bayne | 473/297 |
| 2009/0270197 | A1 * | 10/2009 | Holtzman | 473/296 |
| 2011/0159982 | A1 * | 6/2011 | Takeuchi | 473/299 |

* cited by examiner

*Primary Examiner* — Stephen L. Blau
(74) *Attorney, Agent, or Firm* — Rebecca Hanovice; Michael A. Catania; Sonia Lari

(57) ABSTRACT

A variable length shaft assembly comprising at least one spacer, a shaft portion, and a threaded fastener, wherein the threaded fastener removably connects the spacer to the lower shaft, is disclosed herein. The variable length shaft assembly may further comprise at least two spacers that are stackable on a butt end of the shaft portion so a golfer can adjust the total length of the shaft. Methods of adjusting the length of a golf club shaft without damaging any portion of the shaft and variable length shaft kits are also disclosed herein.

11 Claims, 4 Drawing Sheets

VARIABLE LENGTH GOLF CLUB SHAFT

CROSS REFERENCES TO RELATED APPLICATIONS

The present application claims priority to U.S. Provisional Patent Application No. 61/577,366, filed on Dec. 19, 2011, the disclosure of which is hereby incorporated in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a variable length shaft assembly that allows for quick, semi-permanent length adjustments. More specifically, the present invention relates to a variable length shaft whose length can be adjusted in a short period of time with the use of shaft spacers that are stackable on a butt end of the shaft.

2. Description of the Related Art

Customization of golf clubs to help golfers attain better shots and putts has become a popular and more prevalent practice in recent years. Golf club manufacturers and designers have devised various features to allow club fitters and golf club players to adjust certain characteristics of their clubs. Such characteristics include loft, lie, face angle, center of gravity (CG) location, and club length.

Current technology provides two methods to adjust overall club length. One such method involves the destruction and removal of the grip on a shaft. Upon removal of the grip by peeling or tearing, the end portion of the shaft is trimmed to decrease the club length or an extension piece is affixed to the end of the shaft to increase its length. Aftermarket extensions are available specifically for this purpose; alternatively, extensions can be made from portions of other golf club shafts that are cut to the desired length and then inserted into the end of the first club's shaft. The extension piece must match the diameter of the existing shaft, so it is necessary at times to build up the diameter of the extension or existing shaft by adding layers of tape. This method requires that the user making the adjustments have access to potentially expensive new components and tools as well as having a high level of skill. It also causes damage to the original shaft and grip.

The second method of adjusting club length involves replacing the entire shaft and grip using a semi-permanent head-shaft connection device that some manufacturers offer with their clubs, particularly with drivers. The existing shaft may be removed from the driver head and replaced with a different shaft that has either a shorter or longer length. This method is not possible on all clubs, however, as the head must have hardware that allows for removal of the shaft and replacement with a new shaft without damaging the head.

A golfer who does not possess club altering skills or the necessary disposable income to purchase new components likely will be daunted by these two methods of adjusting club length. The first method requires the golfer to make use of several tools to remove the grip and cut the shaft if he or she desires a shorter length, and also to have materials such as tape and a replacement grip on hand to replace the grip and mend any damage caused to the shaft and grip. The skill set required to change the shaft length using this method is usually beyond the abilities of the average golfer, so the golfer would need to seek the services of a golf club fitter or technician to have their club length changed. The second method requires the golfer to buy an entirely new shaft at a different length, which can be very expensive, and also may require the golfer to retain a golf club fitter or technician to replace the shaft.

Ultimately, the two methods described above require an inventory of spare components and above average technical skill, particularly with regard to the first method. It is therefore desirable to facilitate the change of a club's length using a faster, easier, and less expensive system and method than is currently available.

BRIEF SUMMARY OF THE INVENTION

One aspect of the present invention is a variable length golf club shaft comprising a variable length golf club shaft comprising a shaft comprising a grip, a butt end, and a tip end, a shaft adapter, a spacer having an upper end and a lower end, a cap, and a fastener, which may be a bolt, wherein the shaft adapter is affixed to the butt end of the shaft, wherein the lower end of the spacer engages the shaft adapter, wherein the cap engages the upper end of the spacer, and wherein the fastener fixes the cap and the spacer to the shaft. The lower end of the spacer may comprise a keyed projection and the upper end of the spacer may comprise a keyed socket, and the spacer may have a molded urethane cover is disposed on an exterior surface. The molded urethane cover may be textured to help a golfer more securely grip the shaft. Each of the spacer, shaft, and the shaft adapter may further comprise at least one flat side and at least one curved side. In one embodiment, the shaft adapter may be removably affixed to the shaft. In other embodiments, the spacer may be composed of a plastic material, and the cap may comprise a bore and be composed of a lightweight metal material.

Another aspect of the present invention is a golf club comprising a putter-type head comprising a face and a hosel, a shaft comprising a lower end sized to fit within the hosel, an upper end, and a grip, wherein the grip is disposed proximate the upper end of the shaft, wherein the upper end of the shaft comprises a bore, wherein the shaft is composed of a graphite material, and wherein the grip is composed of an elastomeric material, a shaft adapter comprising a bore, a threaded internal surface, and a keyed socket, the shaft adapter composed of a metal material, a plurality of spacers, each spacer comprising a lower end comprising a keyed projection, an upper end comprising a keyed socket, at least one curved side, at least one flat side, a through-bore, and a molded elastomeric cover disposed on the at least one curved side and the at least one flat side, wherein each of the spacers has a length of no more than 1.25 inches, a cap comprising a keyed projection, a socket, and a through-bore, the cap composed of an aluminum material, and an elongate bolt comprising a head and a threaded body, the elongate bolt composed of a metal material, wherein at least a part of the shaft adapter is bonded within the bore in the upper end of the shaft, wherein the keyed projection of each of the plurality of spacers fits within the keyed socket of the shaft adapter and within the keyed socket of each of the other spacers, wherein the keyed projection of the cap fits within the keyed socket of each of the plurality of spacers, and wherein the threaded body of the bolt extends through the through-bore of the cap and the through bore of each of the plurality of spacers and engages the threaded internal surface of the shaft adapter to secure the cap and the plurality of spacers to the shaft.

In a further embodiment, the upper end of each of the spacers may comprise at least one shallow depression and wherein the lower end of each of the spacers may comprise at least one nub sized to fit within the shallow depression. In another embodiment, each of the plurality of spacers is not rotatable with respect to each other when assembled.

Yet another aspect of the present invention is a kit comprising a golf club comprising a putter-type head affixed to a shaft, the shaft comprising a lower end sized to fit within the hosel, an upper end, a grip, and shaft adapter, a plurality of spacers, each spacer comprising a lower end comprising a keyed projection, an upper end comprising a keyed socket, at least one curved side, at least one flat side, and a through-bore, herein each of the spacers has a length of no more than 1 inch, a cap comprising a keyed projection, a socket, and a through-bore, and an elongate bolt comprising a head and a threaded body, wherein the keyed projection of each of the plurality of spacers fits within the keyed socket of the shaft adapter and within the keyed socket of each of the other spacers, wherein the keyed projection of the cap fits within the keyed socket of each of the plurality of spacers, and wherein the threaded body of the bolt extends through the through-bore of the cap and the through bore of each of the plurality of spacers and engages the threaded internal surface of the shaft adapter to secure the cap and the plurality of spacers to the shaft.

In a further embodiment, the upper end of each of the spacers may comprise at least two shallow depressions, and the lower end of each of the spacers may comprise at least two nubs sized to fit within the shallow depressions. The shaft may be composed of a composite material, the cap may be composed of an aluminum alloy, and the spacers may be composed of a plastic material. In one embodiment, the putter-type head may be a blade putter head. In another embodiment, each of the plurality of spacers may comprise a molded elastomeric cover disposed on the at least one curved side and the at least one flat side. The elastomeric cover may be is textured, and the grip may have the same texture as the elastomeric cover. In a further embodiment, the elastomeric cover may be urethane.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 2B:
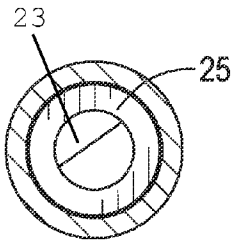
FIG. 2B is a cross-section view of the part shown in FIG. 2A along lines 2B-2B.

The present invention is directed to a variable length shaft that provides club length adjustability. In particular, the present invention is directed to adjustable shafts for belly putters, so that golfers can adjust the overall length of the club to better suit their putting skills.

The present invention provides golfers with a system and method to easily, quickly and inexpensively modify the length of their putters, particularly belly putters, to have them perform in a desired manner. This invention will enable golfers to change their club length wherever they wish, including, but not limited to, at the practice range, the golf course, and their home. The present invention also is designed to avoid altering a club's swing weight or its "feel." The components that are used to alter a club's length are small and can be carried in a pocket of the user's golf bag. Furthermore, the technical ability required to modify the golf club length according to this invention is minimal and its approach is intuitive and easy for a golfer to understand.

A preferred embodiment of the present variable length shaft invention is shown in FIGS. 1-6. According to this embodiment of the invention, a golf club having a shaft 10 and a head 100, preferably a putter head, is provided. An upper portion of the shaft 10 is encircled by a grip 15, which preferably is textured to facilitate gripping by a golfer. The shaft 10 has an upper surface 12 at the top of the grip 15, and has a length of 32 to 55 inches, more preferably 40 to 50 inches, and most preferably approximately 41 inches. The upper surface 12 of the shaft 10 includes a bore 13 sized to receive a shaft adapter 20. The shaft 10 may be manufactured so that the bore 13 is integrally formed, or the bore 13 may be created later by a golfer or a specialist using appropriate machinery.

Figure 5:
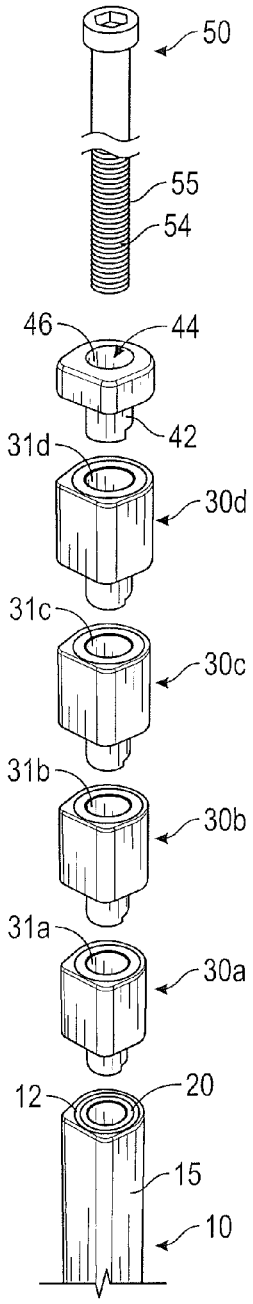
FIG. 5 is an exploded view of the cap, spacers, and bolt of the present invention.

The present invention also comprises a shaft adapter 20, which preferably fits within the bore 13 so that an upper surface 22 of the adapter is flush with the upper surface 12 of the shaft 10, as shown in FIG. 5. The shaft adapter 20 preferably includes a lower projection 24, an upper barrel 26, and a through-bore 28 sized to receive a fastener 50. The part of the through bore 28 located within the lower projection 24 is threaded to receive mating threads 55 of the fastener 50. The exterior surface of the projection 24 also provides an extended bonding surface when the shaft adapter 20 is assembled within the shaft 10 bore 13.

Figure 2A:
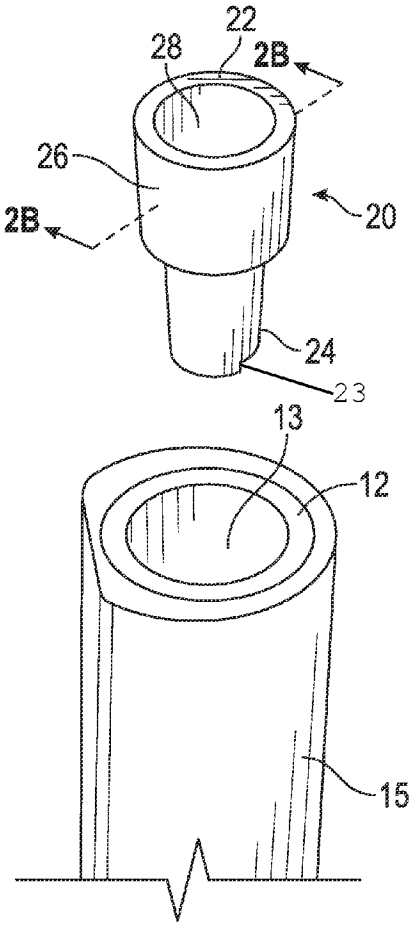
FIG. 2A is a side, perspective view of the part of the putter circled in FIG. 1.
Figure 1:
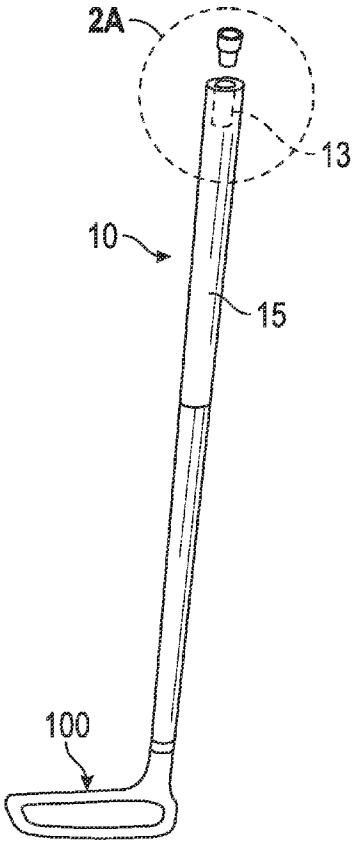
FIG. 1 is a side, exploded view of a putter embodiment of the present invention.

The upper barrel 26 of the shaft adapter 20 includes a keyed feature 25, which may be an opening (not shown) or an interior structure having a stepped portion 23, an example of which is shown in FIGS. 2A and 2B. The keyed feature 25 is sized to receive a part of a spacer 30, preferably the stepped portion 70 of a keyed projection 33 as described herein, and prevent it from rotating when engaged with the shaft adapter 20. The shaft adapter 20 is preferably non-removably bonded within the shaft bore 13 with an adhesive, but in an alternative embodiment may comprise threads disposed at least on an external surface of the projection 24 that mate with internal threads disposed in the shaft bore 13 to permit the shaft adapter 20 to be removably secured within the shaft bore 13. These external threads may also cover the external surface of the barrel 26 to further secure the shaft adapter 20 within the bore 13.

Figure 6:
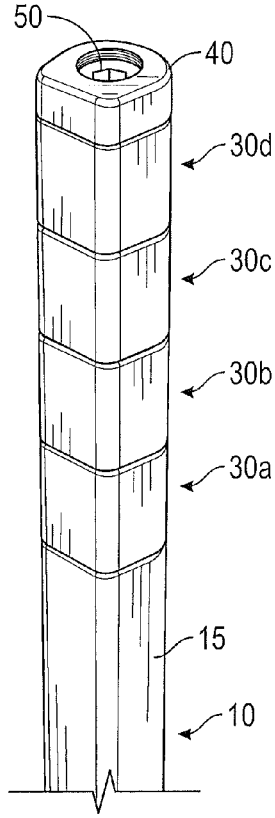
FIG. 6 is an assembled view of the embodiment shown in FIG. 5.

Once the shaft adapter 20 is assembled with the shaft 10, one or more spacers 30 can be added to extend the overall length of the shaft 10. Spacers 30, shown in FIGS. 3A, 3B, 3C, 4, 5, and 6, each comprise a lower end 32 having a keyed projection 33, which includes a stepped portion 70, an upper end 34 having a keyed socket 35, which comprises a protrusion 75, a through-bore 31, and an external surface 39. The keyed projection 33 of each spacer 30 is sized to fit within the keyed socket 35 of each spacer 30, so that the stepped portion 70 engages the protrusion 75 such that multiple spacers 30 can be non-rotatably stacked on top of each other as shown in FIGS. 5 and 6. In the preferred embodiment, the external surface 39 of the spacer 30 includes a curved portion 36 and a flat portion 37, and further comprises a molded urethane cover 38 disposed on the external surface 39, which preferably has the same texturing as the grip 15 to facilitate grasping by the golfer and make the assembly more aesthetically pleasing.

Figure 3B:
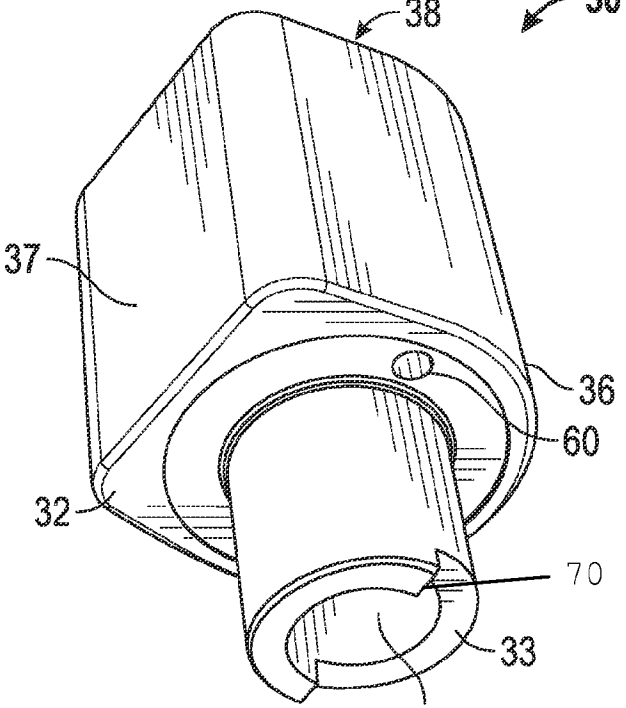
FIG. 3B is a bottom, perspective view of the spacer shown in FIG. 3.
Figure 3A:
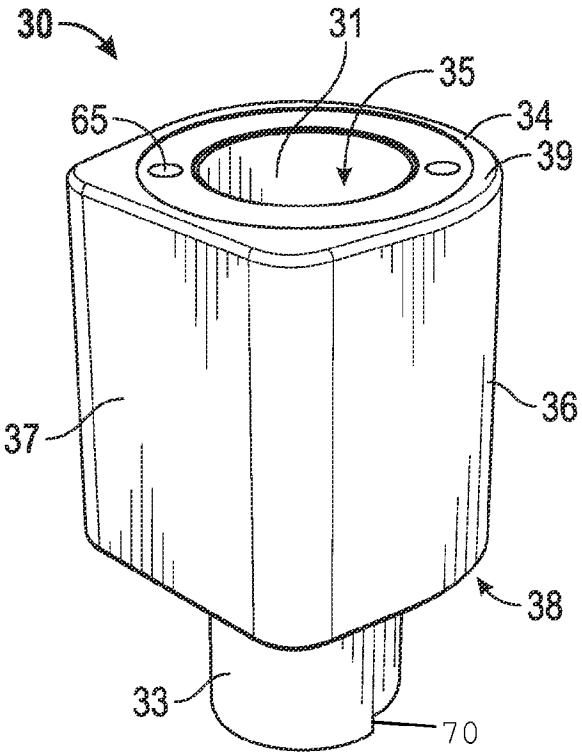
FIG. 3A is a side, perspective view of an embodiment of a spacer of the present invention.
Figure 4:
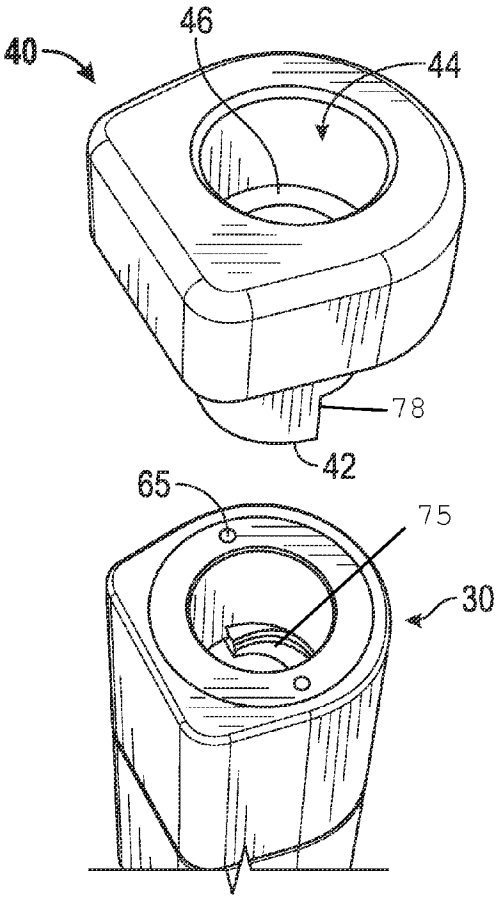
FIG. 4 is a top, exploded view of the spacer shown in FIG. 3C and a cap.
Figure 3C:
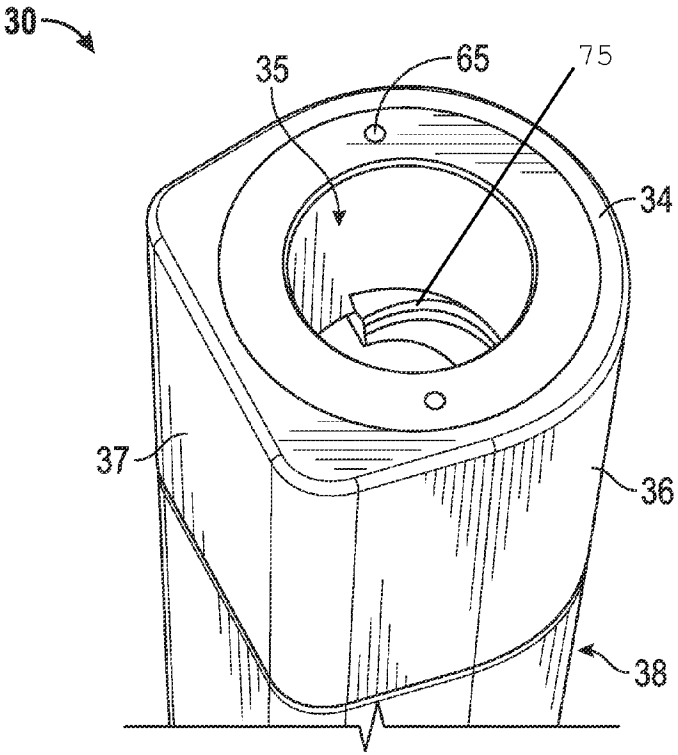
FIG. 3C is a top, perspective view of the spacer shown in FIG. 3 associated with another spacer.

The keyed projections 33 of each spacer 30 are shaped so that spacers 30 can be fitted to each other and to the shaft adapter 20 in only one configuration, preferably one in which the flat side 37 of each spacer 30 lines up. Each spacer 30 preferably has an overall length, from the top-most surface of the socket 35 to the end of the keyed projection 33, of between 0.50 and 1.50 inches, more preferably a length between 0.75 and 1.25 inches, and most preferably a length of approximately 1 inch. In alternative embodiments, the external surface 39 may have any number of curved and/or flat portions 36, 37, may have a cover formed of some other elastomeric or graspable material, and may have another overall length. In the preferred embodiment, the lower end 32 of the spacer 30 further comprises at least one nub 60, as shown in FIG. 3B, and the upper end 34 of the spacer 30 and the upper surface 12 of the shaft 10 each comprise at least one shallow depression 65, as shown in FIGS. 3A, 3C, and 4. During assembly of each spacer 30 with other spacers 30 or the shaft 10, the nubs 60 mate with the shallow depressions 65 to help line up the spacer 30 with whichever piece is disposed below.

Once a golfer has increased the overall shaft length by assembling the desired number of spacers 30 with the shaft adapter 20, the assembly is secured using a removable cap 40 and a fastener 50. The fastener 50, which is preferably an elongated bolt, has a head 52 and a threaded body 54. The cap 40 has a keyed cap projection 42 comprising a stepped portion 78 that is sized to fit within the keyed socket 35 of each of the spacers 30 and engage the protrusion 75, a cap socket 44 sized to receive the fastener head 52 and a through bore 46 to receive the threaded body 54. As shown in FIGS. 5 and 6, to secure spacers 30*a*, 30*b*, 30*c*, 30*d* to a shaft 10 comprising a shaft adapter 20, the keyed cap projection 42 of the cap 40 is inserted into the top-most spacer 30*d* socket 35, and the threaded body 54 of the fastener 50 is threaded through the through bores 31*a*, 31*b*, 31*c*, 31*d*, 46 of the spacers 30*a*, 30*b*, 30*c*, 30*d* and the cap 40 and engaged with the internal threads of the shaft adapter 20 projection 24. The fastener 50 can be tightened using a screwdriver or similar type of tool. Alternatively, if a golfer does not wish to extend the shaft 10, the shaft adapter 20 can be covered with the cap 40 and secured by the fastener 50.

The present invention is useful because the shaft 10 itself never has to be changed in order to adjust the overall shaft length. This invention allows a golfer to increase or decrease the length of a golf club shaft without detaching the shaft 10 from the club head 100 or cutting or otherwise damaging any part of the shaft 10 or grip 15. The parts of the invention may be sold with a golf club as a kit so that golfers can, immediately upon purchase, have all the parts necessary to adjust their new golf club's length.

The parts of the present invention may be composed of any number of durable materials, including metals, plastics, rubbers, and composites. The shaft 10, shaft adapter 20, spacers 30, cap 40 and fastener 50 may be composed of titanium, graphite or carbon composite, plastic, magnesium, aluminum, steel, or alloys of such materials, specifically stainless steel 17-7 or titanium 6-4. The shaft 10 preferably is composed of graphite, the spacers 30 are preferably composed of plastic, the grip 15 preferably is composed of a rubber material, the cap 40 preferably is composed of an aluminum alloy, and the fastener and shaft adapter 20 preferably are composed of a metal material. The pieces of the embodiments disclosed herein may also be bonded together with an adhesive to prevent unwanted separation if the golfer decides he does not want to further adjust the overall club length.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A variable length golf club shaft comprising:
- a shaft comprising a grip, a butt end, and a tip end;
- a shaft adapter comprising a through bore, an upper surface, and a keyed feature comprising a first stepped portion;
- a spacer having an upper end comprising a socket with a protrusion and a lower end comprising a keyed projection having a second stepped portion;
- a cap comprising a third stepped portion; and
- a fastener,
- wherein the grip comprises an upper surface that is flush with an upper surface of the butt end of the shaft,
- wherein the shaft adapter is affixed to the butt end of the shaft such that the upper surface of the shaft adapter is flush with an upper surface of the butt end of the shaft,
- wherein the second stepped portion fits within the shaft adapter and engages the first stepped portion,
- wherein the cap engages the upper end of the spacer such that the third stepped portion engages the protrusion, and
- wherein the fastener fixes the cap and the spacer to the shaft.

2. The variable length golf club shaft of claim 1, wherein the fastener is a bolt.

3. The variable length golf club shaft of claim 1, wherein a molded urethane cover is disposed on an exterior surface of the spacer.

4. The variable length golf club shaft of claim 3, wherein the molded urethane cover is textured.

5. The variable length golf club shaft of claim 1, wherein each of the spacer and grip further comprises at least one flat side and at least one curved side.

6. The variable length golf club shaft of claim 1, wherein the shaft adapter is removably affixed to the shaft.

7. The variable length golf club shaft of claim 1, wherein the spacer is composed of a plastic material.

8. The variable length golf club shaft of claim 1, wherein the cap comprises a bore, and wherein the cap is composed of a lightweight metal material.

9. A golf club comprising
- a putter-type head comprising a face and a hosel;
- a shaft comprising a lower end sized to fit within the hosel, an upper end, and a grip, wherein the grip is disposed proximate the upper end of the shaft, wherein the upper end of the shaft comprises a bore, wherein the shaft is composed of a graphite material, and wherein the grip is composed of an elastomeric material;

a shaft adapter comprising a bore, a threaded internal surface, and a keyed feature comprising a first stepped portion, the shaft adapter composed of a metal material;

a plurality of spacers, each spacer comprising a lower end comprising a keyed projection comprising a second stepped portion, an upper end comprising a keyed socket with a protrusion, at least one curved side, at least one flat side, a through-bore, and a molded elastomeric cover disposed on the at least one curved side and the at least one flat side, wherein each of the spacers has a length of no more than 1.25 inches;

a cap comprising a keyed projection comprising a third stepped portion, a socket, and a through-bore, the cap composed of an aluminum material; and an elongate bolt comprising a head and a threaded body, the elongate bolt composed of a metal material, wherein at least a part of the shaft adapter is bonded within the bore in the upper end of the shaft, wherein the second stepped portion of each of the plurality of spacers is sized to engage with the first stepped portion of the shaft adapter and with the protrusion within the keyed socket of each of the other spacers, wherein the third stepped portion of the cap is sized to fit within the keyed socket of each of the plurality of spacers and engage the protrusion, and wherein the threaded body of the bolt extends through the through-bore of the cap and the through bore of each of the plurality of spacers and engages the threaded internal surface of the shaft adapter to secure the cap and the plurality of spacers to the shaft.

10. The golf club of claim 9, wherein the upper end of each of the spacers comprises at least one circular, shallow depression, and wherein the lower end of each of the spacers comprises at least one circular nub sized to fit within the shallow depression.

11. The golf club of claim 9, wherein each of the plurality of spacers are not rotatable with respect to each other when assembled.

* * * * *